US009263050B2

(12) United States Patent
Daniel et al.

(10) Patent No.: US 9,263,050 B2
(45) Date of Patent: Feb. 16, 2016

(54) ALLOCATION, BY SUB-BANDS, OF BITS FOR QUANTIFYING SPATIAL INFORMATION PARAMETERS FOR PARAMETRIC ENCODING

(75) Inventors: Adrien Daniel, Allauch (FR); Rozenn Nicol, La Roche Derrien (FR)

(73) Assignee: ORANGE, Paris (FR)

( * ) Notice: Subject to any disclaimer, the term of this patent is extended or adjusted under 35 U.S.C. 154(b) by 192 days.

(21) Appl. No.: 14/008,418

(22) PCT Filed: Mar. 28, 2012

(86) PCT No.: PCT/FR2012/050649

§ 371 (c)(1),
(2), (4) Date: Sep. 27, 2013

(87) PCT Pub. No.: WO2012/131253

PCT Pub. Date: Oct. 4, 2012

(65) Prior Publication Data

US 2014/0219459 A1 Aug. 7, 2014

(30) Foreign Application Priority Data

Mar. 29, 2011 (FR) ..... 11 52602

(51) Int. Cl.
*G10L 19/008* (2013.01)
*G10L 19/002* (2013.01)
*G10L 19/02* (2013.01)

(52) U.S. Cl.
CPC ..... *G10L 19/008* (2013.01); *G10L 19/002* (2013.01); *G10L 19/0204* (2013.01)

(58) Field of Classification Search
None
See application file for complete search history.

(56) References Cited

U.S. PATENT DOCUMENTS

| | | | | | |
|---|---|---|---|---|---|
| 4,899,384 | A | * | 2/1990 | Crouse et al. | 704/229 |
| 4,941,152 | A | * | 7/1990 | Medan | 375/245 |
| 4,956,871 | A | * | 9/1990 | Swaminathan | 704/229 |
| 5,054,075 | A | * | 10/1991 | Hong et al. | 704/226 |
| 5,594,833 | A | * | 1/1997 | Miyazawa | 704/221 |
| 5,623,577 | A | | 4/1997 | Fielder | |

(Continued)

OTHER PUBLICATIONS

English translation of Manuel Briand, Etudes d'algorithmes d'extraction des informations de spatialisation sonore : application aux formats multicanaux. Signal and Image processing. Institut National Poly-technique de Grenoble—INPG, 2007. French. <tel-00141862>, pp. 133-147: Codage Parametrique Base Sur L'analyse En Composante Principale.*

(Continued)

*Primary Examiner* — Peter Vincent Agustin
(74) *Attorney, Agent, or Firm* — David D. Brush; Westman, Champlin & Koehler, P.A.

(57) ABSTRACT

A method is provided for allocating bits for quantifying spatial information parameters by frequency sub-band for parametric encoding/decoding of a multichannel audio stream representative of a soundstage consisting of a plurality of sound sources. The method includes a step of quantifying or inversely quantifying, by frequency sub-band, spatial information parameters for the sound sources of the soundscape. The method further includes: assessing a spatial resolution of the current sub-band on the basis of the spectral properties of the sub-band; and determining a number of bits to be allocated to the current sub-band, the number of bits to be allocated being inversely proportional to the estimated spatial resolution. Also provided is a device for allocating quantification bits implementing the above-described method.

14 Claims, 3 Drawing Sheets

(56) References Cited

U.S. PATENT DOCUMENTS

| | | | | |
|---|---|---|---|---|
| 5,632,003 | A * | 5/1997 | Davidson et al. | 704/200.1 |
| 5,732,386 | A * | 3/1998 | Park et al. | 704/203 |
| 6,310,564 | B1 * | 10/2001 | Fujimoto | 341/55 |
| 6,393,393 | B1 * | 5/2002 | Kawahara | 704/229 |
| 6,693,963 | B1 * | 2/2004 | Taniguchi | 375/240.11 |
| 2002/0138259 | A1 * | 9/2002 | Kawahara | 704/229 |
| 2007/0269063 | A1 * | 11/2007 | Goodwin et al. | 381/310 |
| 2009/0198500 | A1 * | 8/2009 | Garudadri et al. | 704/500 |
| 2014/0219459 | A1 * | 8/2014 | Daniel et al. | 381/23 |

OTHER PUBLICATIONS

Manuel Briand: "Etudes d'algorithmes d'extraction des informations de spatialisation sonore: application aux formats multicanaux", 2007, pp. 133-147, XP002661237.

Adrien Daniel et al: "Multichannel Audio Coding Based on Minimum Audible Angles", Proceedings of 40th International Conference: Spatial Audio: Sense the Sound of Space, Jan. 1, 2010, pp. 1-10, XP055009518, section 2.

International Search Report and Written Opinion of the International Searching Authority dated May 14, 2012 for corresponding International Application No. PCT/FR2012/050649, filed Mar. 28, 2012.

* cited by examiner

ALLOCATION, BY SUB-BANDS, OF BITS FOR QUANTIFYING SPATIAL INFORMATION PARAMETERS FOR PARAMETRIC ENCODING

CROSS-REFERENCE TO RELATED APPLICATIONS

This Application is a Section 371 National Stage Application of International Application No. PCT/FR2012/050649, filed Mar. 28, 2012, which is incorporated by reference in its entirety and published as WO 2012/131253 on Oct. 4, 2012, not in English.

STATEMENT REGARDING FEDERALLY SPONSORED RESEARCH OR DEVELOPMENT

None.

FIELD OF THE DISCLOSURE

The present invention pertains to the coding of multichannel audio streams representing spatialized sound scenes with an objective of storage or transmission.

It pertains more particularly to the parametric coding/decoding of multichannel audio streams.

This type of coding is based on the coding of a signal arising from a multichannel audio stream channel downmix processing and the associated coding of spatial information parameters of the sound sources. Thus, on decoding, the spatial information parameters are used to retrieve the spatialization of the sound sources on the basis of the "downmix" signal that will subsequently be called the sum signal.

The invention pertains more particularly to the coding and to the decoding of these spatial information parameters.

BACKGROUND OF THE DISCLOSURE

To code these spatial information parameters, the bit budget available, depending on the coders, is not always sufficient. In the case of frequency sub-band coding, this budget is divided per sub-band.

There exist techniques which make it possible to reduce the number of bits to be allocated per sub-band. One of these techniques consists in coding only the parameters of one frequency band out of two for each temporal frame. Thus the sub-bands not coded in the current frame are allotted the corresponding values of the previous frame.

Another technique is to perform an intra or inter-frame differential coding.

Most of the time, these allocation techniques are not based on criteria of auditory perception that a listener may have of the sound signal. Therefore, these parameters are quantized in a uniform manner.

A quantization based on psycho-acoustic criteria is proposed by Breebaart in the document by Breebaart, J; Van de Par, S; Kohlrausch, A & Schuijers, E, "Parametric Coding of stereo Audio" in EURASIP Journal on Applied Signal Processing, 2005, 9, pp 1305-1322. The scheme described in this document is based on the perception that a listener may have on certain frequency bands for particular parameters of inter-channel difference type, or on the sensitivity to a variation of these parameters as a function of the relevant span of values. It is for example described that certain parameters are coded only on the frequency bands below 1 kHz. Beyond this frequency, the parameters are indeed no longer useful to the auditory system to locate a source. Thus, the psycho-acoustic criterion used here relates to a sensitivity to the coded parameters and not to a sensitivity of spatial displacements of the sound sources.

Now, auditory perception or sensitivity with respect to a spatial resolution in the sub-bands may vary at each instant from one sub-band to another, independently of the parameter to be coded.

SUMMARY

An embodiment of the present disclosure proposes a method for allocating quantization bits for spatial information parameters per frequency sub-band, for a parametric coding/decoding of a multichannel audio stream representing a sound scene consisting of a plurality of sound sources and comprising a step of quantization/inverse quantization per frequency sub-band of spatial information parameters of the sound sources of the sound scene. The method is such that it comprises the following steps:

- estimation of a spatial resolution of the current sub-band on the basis of spectral properties of the sub-band;
- determination of a number of bits to be allocated to the current sub-band, the number of bits to be allocated being inversely proportional to the estimated spatial resolution.

Thus, the method according to the invention uses a psycho-acoustic criterion to optimize the strategy for allocating the quantization bits for the spatial information parameters as a function of the sub-band, so as to favor at each instant the sub-bands which are the most useful to the auditory system, and to do so whatever the spatial information parameters to be coded or decoded.

The spatial resolution properties of the auditory system are thus utilized. The spatial resolution in a sub-band can be defined as the smallest angle between two sources, that the auditory system is capable of discriminating.

The various particular embodiments mentioned subsequently can be added independently or in combination with one another, to the steps of the allocation method defined hereinabove.

In a particular embodiment, the spectral properties of a sub-band are represented by the central frequency of the sub-band.

To a central frequency of a sub-band there then corresponds a spatial resolution for the sub-band. This scheme for estimating the spatial resolution is then very simple and does not require any analysis in the sub-bands. The allocation is then determined by the sub-band split and does not depend on the content.

In another embodiment, the spectral properties of a sub-band are properties of energy in the sub-band.

In this case, the spatial resolution associated with a sub-band is inversely proportional to the energy in this sub-band. Thus in this embodiment, the more energy a sub-band contains, the smaller its resolution is estimated to be and the bigger the number of bits allocated for this sub-band.

Moreover, if the energy in a sub-band is high, this already gives an indication of the weak influence that the other sub-bands can have with respect to the latter and thus gives a first dynamic allocation approach (taking the other sub-bands into account).

The energy properties can correspond to the energy measured in the sub-band or more precisely to a measurement of the energy-related distance of this sub-band from its masking/audibility threshold.

So as to refine the estimation of the spatial resolution in the sub-bands, the spectral properties of a sub-band are at one and the same time properties of energy in the sub-band and the central frequency of the sub-band.

In a particular embodiment, the spatial resolution of a sub-band is estimated furthermore on the basis of the spectral properties of the other sub-bands of a set of sub-bands defining the sound sources.

For a given sub-band, the other sub-bands can be considered to be distractive competing sources which are liable to degrade the spatial sensitivity associated with this sub-band. By taking into account the spectral properties of the other frequency sub-bands it is made possible to estimate this degradation and to predict the spatial resolution associated with the sub-band. This taking into account makes it possible to dynamically define the precision with which it is necessary to code the spatialization information associated with each sub-band, on the basis of a decrease or of an increase in the spatial resolution. Thus, the resulting quantization error is adapted as a function of spatial sensitivity so as to minimize the error when the sensitivity is a maximum, and conversely to maximize it when the sensitivity is a minimum. The quantization error is thus, from a perceptive point of view, minimized in a homogeneous manner.

In an advantageous embodiment, the spectral properties of a sub-band are obtained on the basis of a decoded sum signal arising from a reduction processing of the channels of the multichannel audio stream.

The estimation of the spatial resolution per sub-band does not require any information of the type regarding the position of the sound sources but only information about the spectral properties of the sub-bands. This information can therefore be obtained on the basis of the sum signal decoded either locally in a coder in the coding step or decoded by the decoder itself in the decoding step. It is therefore not necessary to send additional information to the decoder to retrieve the strategy for allocating quantization bits. This thus greatly reduces the amount of information to be transmitted between the coder and the decoder.

In a variant embodiment, the energy properties in a sub-band comprise the properties of primary energy and of ambient energy in the sub-band.

The share of energy that is correlated (primary energy) between the various channels of the multichannel signal is differentiated from the energy that is uncorrelated (ambient) in the psycho-acoustic model making it possible to estimate the spatial resolution. Thus, the estimation of the spatial resolution is more precise and closer to reality.

In a particular embodiment, the number of bits to be allocated for a sub-band forms part of a predetermined number of bits to be distributed between the sub-bands, plus an already allocated number of bits per sub-band.

The allocation defined here applies with regard to a number of bits remaining to be allocated in a budget of quantization bits, some of the quantization bits of the global budget having already been distributed between the sub-bands.

Thus, at the decoder, it is possible to decode the spatial information parameters approximately on the basis of the already allocated quantization bits, the additional bits budget making it possible to refine the decoding and to adapt it to the auditory perception.

In another particular embodiment, the determination of the number of bits to be allocated for a sub-band is adjusted as a function of the difference between the resolution in this sub-band and a predetermined reference resolution, to which there corresponds a predetermined allocation of reference bits.

We concern ourselves here with a context of transmission with unconstrained bitrate where a target spatial coding quality is chosen and imposed. A reference resolution is then predetermined and a number of bits to be allocated for this resolution is predefined. If the estimated resolution is different from this reference resolution, the allocation process such as defined here then applies.

In a particular embodiment, the method is implemented for a set of non-masked sub-bands which is determined by a step of analysis of energy-related masking between sub-bands.

Thus, when certain frequency sub-bands are masked by other sub-bands, for example when they exhibit too low an energy level, it is therefore not necessary to preserve the spatial information of these masked sub-bands. Thus, the allocation method is implemented only for the audible sub-bands, that is to say non-masked sub-bands, thereby making it possible to concentrate the bits budget to be allocated on these sub-bands.

This affords a saving in calculation since the method is not implemented in all the sub-bands and a saving in transmission since the spatial information parameters associated with the masked sub-bands will not be transmitted (0 allocated bits).

Moreover, these energy-related masking properties can be determined on the basis of the decoded sum signal. It is therefore not necessary to transmit this information to the decoder.

The present invention is also aimed at a device for allocating quantization bits for spatial information parameters per frequency sub-band, for a parametric coder/decoder of a multichannel audio stream representing a sound scene consisting of a plurality of sound sources and comprising a module for quantization/inverse quantization per frequency sub-band of spatial information parameters of the sound sources of the sound scene. The device is such that it comprises:

- a module for estimating a spatial resolution of the current sub-band on the basis of spectral properties of the sub-band;
- a module for determining a number of bits to be allocated to the current sub-band, the number of bits to be allocated being inversely proportional to the estimated spatial resolution.

This device exhibits the same advantages as the method described above, which it implements.

The invention is aimed at a coder or a decoder comprising such an allocation device.

It is aimed at a computer program comprising code instructions for the implementation of the steps of the allocation method such as described, when these instructions are executed by a processor.

Finally the invention pertains to a storage medium, readable by a processor, possibly integrated into the allocation device, optionally removable, storing a computer program implementing an allocation method such as described above.

BRIEF DESCRIPTION OF THE DRAWINGS

Other characteristics and advantages of the invention will be more clearly apparent on reading the following description, given solely by way of nonlimiting example and with reference to the appended drawings in which.

DETAILED DESCRIPTION OF ILLUSTRATIVE EMBODIMENTS

Figure 1:
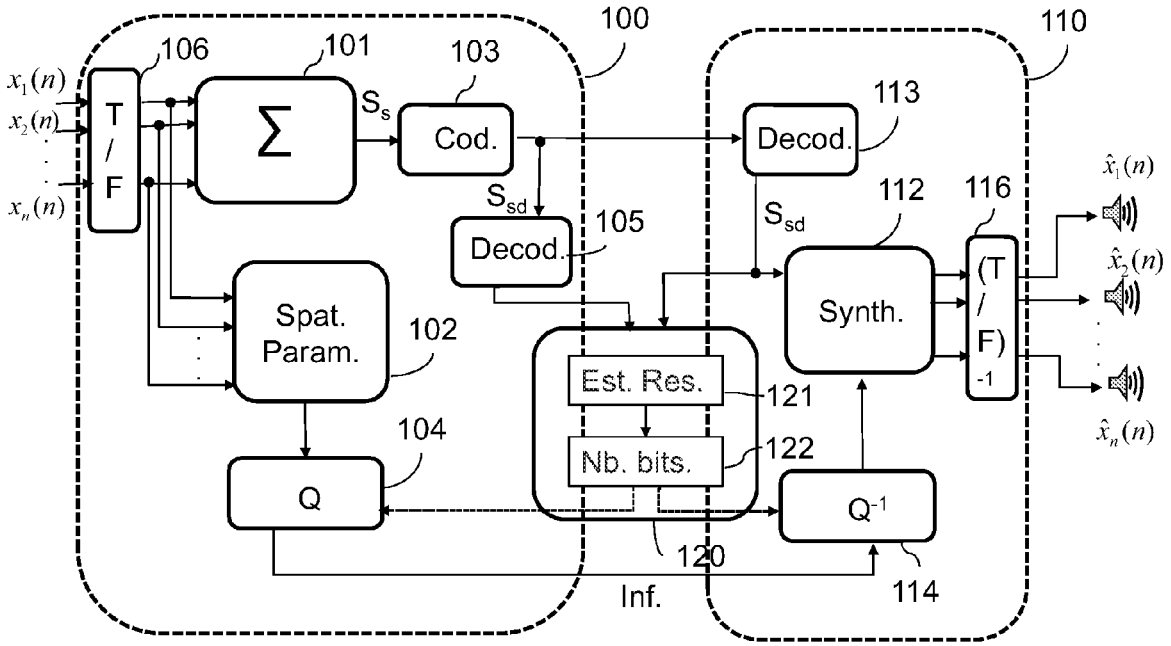
FIG. 1 illustrates a system for parametric coding and decoding of a multichannel audio stream in which the allocation device according to one embodiment of the invention is envisaged.

FIG. 1 thus describes a system for parametric coding/decoding of a multichannel audio stream. This figure illustrates the coder 100, the decoder 110 as well as the allocation device 120 according to one embodiment of the invention.

The channels $x_1(n), x_2(n), \ldots, x_n(n)$ of the multichannel audio stream are firstly transformed by a time/frequency transformation module 106, before being applied as input both to a channels reduction processing module 101 or "Downmix" module and to a spatial information parameters extraction module 102.

The transformation operated by the module 106 can be of various types. It can use for example a filter bank technique, or else a Short-Term Fourier Transform (STFT) technique by using an algorithm of FFT ("Fast Fourier Transform") type. In the case of a filter bank technique, the filters can be defined in such a way that the resulting frequency sub-bands describe perceptive frequency scales, for example by choosing constant bandwidths in the ERB scales (the initials standing for "Equivalent Rectangular Bandwidth"). The same process can be applied in the case of an STFT-based technique by grouping the frequency bins of each temporal frame according to the ERB scales.

A "downmix" signal or sum signal, arising from the channels reduction processing module 101 (mono or stereo signal) is obtained by summation, optionally weighted, of the various channels in each sub-band. This sum signal is thereafter coded by a core coding module 103 which can be of various types, for example of MPEG-4 AAC standardized audio coding type. This coded signal is thereafter transmitted over the network so as to be subsequently decoded by the corresponding core decoder 113.

The module 102 extracts the spatial information parameters of the audio channels. These parameters are those which describe the spatial position of the channels. These parameters may be for example the pair of parameters ILD (for "Interaural Level Difference") and IPD (for "Interaural Phase Difference") as defined for the stereo parametric coding scheme described in the document by Breebaart, J; Van de Par, S; Kohlrausch, A & Schuijers, E, "Parametric Coding of stereo Audio" in EURASIP Journal on Applied Signal Processing, 2005, 9, pp 1305-1322.

These parameters may, in another example, be of primary and ambient position vector type such as for the representation described in the document "Spatial audio scene coding" by Goodwin, M. & Jot, J., 125th AES Convention, 2008 Oct. 2-5, San Francisco, USA, 2008.

The techniques for extracting these parameters are well known and will not therefore be described here.

The spatial information parameters thus extracted are thereafter quantized by the quantization module 104 according to a quantization bits allocation defined by the allocation device 120.

The allocation device 120 implements an allocation method which will be described with reference to FIG. 2.

This allocation device 120 receives as input the sum signal decoded $S_{sd}$ by a local decoder 105 of the coder or in the case of the decoder, decoded by the decoding module 113.

On the basis of this decoded sum signal $S_{sd}$ a module 121 for estimating a spatial resolution per frequency sub-band determines the spectral properties of the frequency sub-bands.

In a first embodiment, a spectral property of a frequency sub-band is the central frequency of this sub-band.

In another embodiment, the spectral properties determined are properties of energy in the sub-band.

In yet another embodiment, the spectral properties are at one and the same time the energy properties and the central frequency in the sub-band.

These spectral properties will make it possible to determine a spatial resolution per frequency sub-band. This spatial resolution corresponds to the smallest angle between two sources that the human auditory system can discriminate. This spatial resolution can also be dubbed MAA (for "Minimum Audible Angle") as defined by the document by Mills A. W "On the Minimum Audible Angle" in The Journal of the Acoustical Society of America, 83(S1):S122, May 1988.

The determination of this spatial resolution will be explained in greater detail with reference to FIG. 2.

The spatial resolution per frequency sub-band thus determined makes it possible to determine a number of bits to be allocated to the sub-band for the quantization of the spatial information parameters. This step is implemented by the module 122 for determining the number of bits. This step will be explained in greater detail with reference to FIG. 2.

This allocation of the number of bits per frequency sub-band is then based on psycho-acoustic rather than purely mathematical considerations as was done previously in the prior art. Thus, this allocation takes into account the perception of the auditory system in the frequency bands.

Indeed, the errors of quantization of the spatial parameters are manifested as changes of position of the sound sources at the moment of decoding. These changes of position induce a spatial distortion of the sound scene which, evolving over time, is manifested as a spatial instability. The spatial resolution can be interpreted as a sensitivity to this spatial distortion. This sensitivity can be expressed for each sub-band by the module 121. The allocation device 120 will then model the quantization error as a function of this sensitivity so as to minimize the error when the sensitivity is a maximum, and conversely to maximize it when the sensitivity is a minimum.

The allocation thus determined makes it possible to quantize (Q) at the coder, the spatial information parameters by the quantization module 104 or to perform an inverse quantization ($Q^{-1}$) at the decoder by the inverse quantization module 114 so as to obtain these parameters.

Thus, at the decoder 110, the synthesis module 112 will be able, on the basis of the spatial information thus dequantized and of the decoded sum signal $S_{sd}$, to obtain the multichannel audio stream in the frequency domain and then after inverse time/frequency transformation of the module 116, the audio stream in the temporal domain $\hat{x}_1(n), \hat{x}_2(n), \ldots, \hat{x}_n(n)$.

Figure 2:
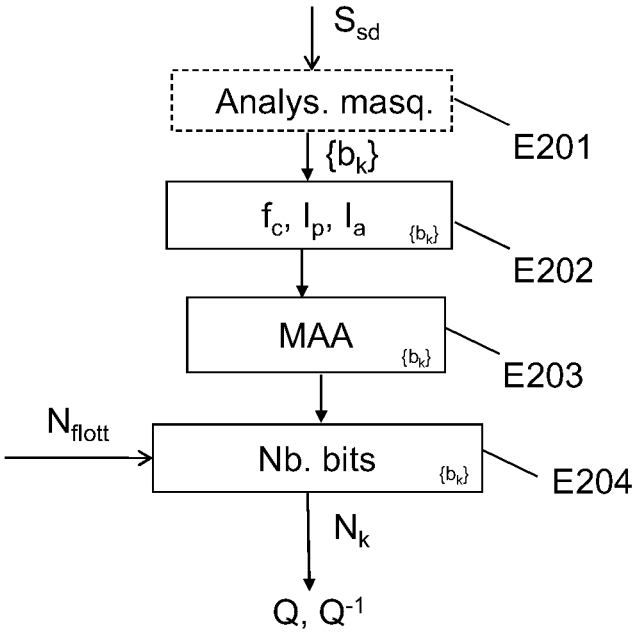
FIG. 2 illustrates, in flowchart form, the steps of an allocation method according to one embodiment of the invention.

FIG. 2 now illustrates the steps of the method for allocating bits in an embodiment of the invention.

On the basis of the decoded sum signal $S_{sd}$, a step of analysis E201 of energy-related masking between the frequency sub-bands may optionally be performed.

This step makes it possible to select a set of frequency sub-bands audible by the auditory system.

Indeed, within one and the same frame, a sub-band exhibiting a high energy level can potentially mask (i.e. render inaudible) the neighboring sub-bands exhibiting too low an energy level. Thus, during a prior step E201, it is possible to perform a compared analysis of the energies of the various sub-bands so as to determine whether certain sub-bands are not masked by other sub-bands. It is then irrelevant to preserve the spatial information regarding the masked sub-bands, thus freeing quantization bits for the other sub-bands for the quantization bits allocation process given by the following steps of the method.

A set of sub-bands $\{b_k\}$ is thus defined to implement the steps of the allocation method.

In turn, each sub-band is considered to be a target source, the other sub-bands being able to be considered to be distractive sources.

In step E202, spectral properties of the sub-bands of the set $\{b_k\}$ are extracted.

According to several embodiments, these spectral properties are either solely the central frequency $f_c$ of the current sub-band, or solely its energy properties (I), or both.

However, the energy contained in each sub-band does not entirely reflect reality in terms of perception at the moment of restoration, this being because only a part of this energy will be restored in a correlated manner between the various channels. The remainder will be restored in a decorrelated manner. It is therefore beneficial to estimate and to specify to the psycho-acoustic model which share of the energy will be correlated (primary energy) and which non-correlated (ambient energy).

The energy properties can then be discriminated as primary energy ($I_p$) which represents the energy correlated between the sub-bands and the ambient energy ($I_a$) representing the energy decorrelated in the current sub-band.

On the basis of the knowledge of one or more of these parameters, step E203 performs an estimation of the spatial resolution in the current sub-band. Each sub-band being considered in turn as target.

Accordingly, a psycho-acoustic model $\Psi$ is determined and makes it possible to obtain the spatial resolution or else the MAA, associated with each sub-band.

As mentioned previously, the spatial resolution of the auditory system can be defined as the smallest angle between two sound sources that the system is capable of discriminating. The reference study by Mills mentioned hereinabove has been bolstered by more recent studies described for example in the document by Perrot D. R and Saberi K., "Minimum audible angle thresholds for sources varying in both elevation and azimuth" in The Journal of the Acoustical Society of America, 87(4):1728-1731, April 1990.

These studies conclude an MAA of between 1° and 3° in azimuth for a frontal source, as a function of its frequency content. In a context of representing the spatial information of a sound scene, the MAA defines the minimum precision with which the position of a sound source must be described so as not to introduce audible artifacts. A position error of less than the MAA will not be perceived by the auditory system. Thus the MAA represents the "spatial fuzziness" of perception of a sound source.

A simplified psycho-acoustic model according to the invention takes into account only the central frequency of the current sub-band. In this case, the central frequency of the sub-band considered defines its associated MAA according to a correspondence lookup table predefined for example by subjective tests. Such a correspondence is for example described in the document by Mills cited hereinabove.

Another simplified psycho-acoustic model takes into account only the energy properties of the current sub-band.

In a simple manner, the energy properties correspond to the energy measured in the sub-band. In this case, the associated MAA is considered to be inversely proportional to the energy in this sub-band.

More precisely, the energy properties correspond to a measurement of the energy-related distance of this sub-band from its masking/audibility threshold. One then speaks of audible energy in the sub-band. The MAA associated with this sub-band is also inversely proportional to the audible energy in this sub-band. Stated otherwise, the more audible energy a sub-band contains, the smaller its MAA will be assumed to be.

Finally, it is possible to combine this latter possibility with the former so as to refine it, by weighting the MAA estimated via the energy-related distance from the masking/audibility threshold with the MAA estimated using the central frequency.

In a particular embodiment, the psycho-acoustic model does not take into account only the characteristics of the current sub-band but also those of the other sub-bands which are then considered to be distractive sub-bands.

Indeed, experimental measurements have made it possible to show that the MAA (or spatial resolution) changes in the presence of distractive sources, and that more specifically, it tends to increase. Thus, the action, on a given source, of the competing sources, may be seen as a "spatial blurring" of this source. The "blurring" effect depends on the frequency content of the source and its energy, and likewise it depends on the frequency content and the energy of each of the competing sources.

On the other hand the effect of the position of the distractive sources on the "blurring" is negligible, in the sense that the MAA can be estimated without the distractive sources position information. Nonetheless, the MAA associated with a source depends on the position of this source with respect to the listener's head. The best performance (the lowest MAA) is observed when the listener faces the relevant source. Thus, in the psycho-acoustic model according to the invention, the assumption is made that the listener is free to orient his head within the listening device. Accordingly it is assumed, when estimating the MAA associated with a given source, that the listener always faces the relevant source. As a consequence of these results, to estimate the MAA associated with a given source, the position information for this source is not necessary. On the basis of these results, a psycho-acoustic model which describes the MAA associated with a given source can be constructed as a function of the presence and properties (energy, frequency content) of other sources.

The energy information alone suffices to determine the "spatial blurring" correctly. The position information is therefore irrelevant. It follows from this that the MAA associated with the various sub-bands can be calculated on the basis of the "downmix" component or sum signal as described with reference to FIG. 1. The consequence is that, for the decoding, it is not necessary to transmit the quantization strategy, but that it can be deduced from the sum signal according to the same procedure as when encoding.

Ultimately, the psycho-acoustic model is described by a function $\Psi(c,d_1,d_2, \ldots, d_N)$, where c represents the target source, and the $d_i$ are the distractive sources.

In this embodiment, each sub-band constitutes a source characterized by its central frequency and its energy (primary and ambient). For each of these sources, then considered to be target, the function $\Psi$ produces the MAA which is associated therewith in the presence of the other sources considered to be distractive, that is to say the non-perceptible maximum position error applicable to this source in the presence of the others.

Thus, each source (target or distractive) is characterized in step E202 by three parameters $\{f_c,I_p,I_a\}$, where $f_c$ is the central frequency of the sub-band considered, and $I_p$ and $I_a$ are respectively the primary and ambient energy in this sub-band. On the basis of the knowledge of these parameters $\{f_c,I_p,I_a\}$ for all the sub-bands, the psycho-acoustic model $\Psi(c,d_1,$ $d_2, \ldots, d_N$) produces a pair of values of MAA $\{\alpha_p, \alpha a\}$, corresponding respectively to the components of primary and ambient energy, associated at step E203 with each sub-band considered in turn as target.

Depending on whether the parameter to be coded represents a primary or ambient component, the value of MAA considered will be $\alpha_p$ or $\alpha_a$ respectively, and consequently this distinction will no longer be made subsequently in the document. If the $I_p/I_a$ distribution is unknown (non-transmitted parameter), the decoder will presuppose that all of the energy is correlated (primary energy), likewise the psycho-acoustic model, so as to obtain a correspondence during restoration.

Thus, for each sub-band $b_k$ from among K sub-bands, the function $\Psi(b_k, b_1, \ldots, b_{k-1}, b_{k+1}, \ldots, b_K)$ is called to estimate the spatial "blurring" exerted on this sub-band by the other sub-bands, which are therefore considered to be distractive, and $\Psi$ produces the MAA associated with this sub-band. The estimation of the spatial resolution is then done in a dynamic manner since the influence of the other sub-bands is taken into account.

The various spatial resolutions thus estimated in the frequency sub-bands make it possible to determine the number of bits to be allocated for the quantization of the spatial information parameters in each of the sub-bands.

Thus, in step E204, a determination of the number of bits to be allocated to the current sub-band as a function of the estimated spatial resolution is performed.

The strategy for allocating the quantization bits for the spatialization parameters will then consist in maximizing the number of bits for the sub-bands exhibiting the minimum MAA, to the detriment of the sub-bands for which the MAA is a maximum.

Thus, the number of bits to be allocated for a sub-band is inversely proportional to the estimated spatial resolution for this sub-band.

The allocation method can therefore adapt the allocation of bits from one sub-band to another according to the auditory system's sensitivity to a spatial distortion. This sensitivity is given by the psycho-acoustic model.

This method can be implemented equally well in a context of transmission with constrained bitrate and in a context of transmission with unconstrained bitrate.

In both cases, a share of the bits budget is left available for a variable allocation from one sub-band to another as a function of the MAA associated with the latter. A certain budget of "floating" bits has therefore to be distributed between one and the same parameter of each of the sub-bands so as to perceptively minimize the spatial distortion resulting from the quantization process, in a homogeneous manner in each of the sub-bands. The remainder of the bits budget is equitably distributed between all the sub-bands. The spatial coding quality is therefore defined by the mean number, over all the sub-bands, of bits allocated to one and the same parameter, or, equivalently, by the total number of bits allocated to one and the same parameter for all the sub-bands.

In a context of transmission with unconstrained bitrate, a target spatial coding quality is chosen and imposed by the user. This target quality is defined by the mean number, over all the temporal frames and over all the sub-bands, of bits assigned to one and the same parameter. Thus, the mean MAA, then considered to be a reference resolution value, is assumed to be estimatable or predictable, taking all sub-bands together, on all or some of the temporal frames.

The sub-bands whose estimated MAA equals the mean MAA will be allocated the mean number of bits per parameter defined by the user. The allocation of bits for the other sub-bands is done, as in a constrained bitrate context, so as to perceptively minimize the spatial distortion resulting from the quantization process, in a homogeneous manner in each of the sub-bands, but given the number of bits to be allocated to the sub-bands of mean MAA. Thus, in this embodiment, the determination of the number of bits to be allocated for a sub-band is performed if the resolution in the sub-band is different from a predetermined reference value, here the mean MAA.

In each of the contexts, a certain minimum number of bits is already allocated per sub-band to code each parameter, this on the one hand ensuring a minimum quality of spatial reproduction for all the audible sub-bands, and on the other hand affording an approximate value of the parameter concerned which is accessible to the decoding.

To simplify, we shall illustrate the allocation strategy for one of the parameters to be coded per sub-band. But the method is exactly the same for the other parameters of each sub-band. It is considered that an arbitrary temporal frame is processed.

K: number of sub-bands to be coded (audible sub-bands)

N: total number of bits to be allocated $n_{fixed}$: minimum number of bits assigned to the parameter of each sub-band $N_{float}$: number of floating bits to be distributed between the sub-bands (following psycho-acoustic model)

$b_k$: sub-band k, $k \in \{1, \ldots, K\}$ $\text{argmax}_k(N_k)=m$: index of the sub-band to which the most bits are allocated $\Psi(b_k, b_1, \ldots, b_{k-1}, b_{k+1}, \ldots, b_k)=\alpha_k$: MAA associated with sub-band k (given by the psycho-acoustic model)

$N_k$: number of floating bits allocated to the parameter of $b_k$ $N'_k$: number of bits allocated to the parameter of $b_k$ in total ($N'_k=n_{fixed}+N_k$)

The total bits budget is defined by:

$$N=K\times n_{fixed}+N_{float}.$$

Whatever the distribution of the quantization values (uniform or otherwise), it is assumed that adding a coding bit doubles the number of quantization values and therefore doubles the precision of the representation of the value to be coded. If this assumption is not satisfied, formulae (1) and (1') stated below must be adjusted accordingly.

With constrained bitrate, in order that the error of quantization of the spatialization parameters be modeled according to the threshold of sensitivity to an angular displacement, the sub-band coded on the most bits (bm) must be the sub-band having the smallest MAA ($\alpha_m$), and the ratio of coding precision between the current sub-band bk and bm must be inversely proportional to the ratio of the MAAs of these two sub-bands:

$$\frac{2^{N_k}}{2^{N_m}} = \frac{a_m}{a_k}, \text{ with } N_k, N_m \in \mathbb{N}^{+*}, \text{ and } a_k, a_m \in \mathbb{R}^{+*}. \tag{1}$$

Hence:

$$N_k = N_m + \log_2 \frac{\alpha_m}{\alpha_k}. \tag{2}$$

Moreover, the sum of the floating bits of each sub-band must not exceed the total number of available floating bits $N_{float}$:

$$\Sigma N_k \leq N_{float}.$$

Hence, by feeding the above expression for $N_k$ into this relation:

$$N_m \leq \frac{N_{float} - \log_2\left(\prod \frac{\alpha_m}{\alpha_k}\right)}{K}. \quad (3)$$

Formulae (2) and (3) give respectively a first approximation of the number of bits to be allocated to the parameter of the sub-bands $N_k$ and $N_m$. If bits remain to be allocated, or if too many bits have been allocated, the following heuristic (so-called "greedy" algorithm) makes it possible to finalize the process for allocating the floating bits. Let $\Delta_k$ be the discrepancy, derived from formula (1), between the optimal coding precision and the current precision for sub-band k:

$$\Delta_k = \frac{\alpha_m}{\alpha_k} - \frac{2^{N_k}}{2^{N_m}}. \quad (4)$$

The index of the sub-band to which the next bit has to be allocated or taken back will be determined respectively by $\text{argmax}_k(\Delta_k)$ or $\text{argmin}_k(\Delta_k)$ . $\Delta k$ is recalculated after each operation (allocation or retraction) on a bit. The allocation is finalized when the total number of floating bits allocated equals exactly $N_{float}$.

Particular case: when $\forall k \cdot \Delta_k = 0$ and the number of allocated bits does not equal $N_{float}$, the sub-band which must receive the next bit (respectively from which the latter must be removed) is the sub-band whose MAA is the smallest (respectively the highest).

Note: it is also possible to make the complete allocation with this algorithm.

Ultimately, the number $N'_k$ of bits allocated in total to the coding of the parameter of sub-band $b_k$ equals:

$$N'_k = n_{fixed} + N_k \quad (5)$$

With unconstrained bitrate, it is necessary to introduce three new variables:

$^{-}\alpha$: mean MAA (estimated or predicted) or reference spatial resolution, taking all sub-bands together, on all or part of the temporal frames $b_{-\alpha}$: dummy reference sub-band, of $MAA^{-\alpha}$ $^{-}N$: number of floating bits assigned to the parameter of $b_{-\alpha}$ The ratio of coding precision between the current sub-band $b_k$ and the reference sub-band $b_{-\alpha}$ must be inversely proportional to the ratio of the MAAs of these two sub-bands:

$$\frac{2^{N_k}}{2^{-N}} = \frac{^{-}a}{a_k}, \text{ with } N_k, {}^{-}N \in \mathbb{N}^{+*}, \text{ and } a_k, {}^{-}a \in \mathbb{R}^{+*}. \quad (1')$$

The number of floating bits to be allocated to each parameter is therefore given by:

$$N_k = {}^{-}N + \log_2 \frac{^{-}\alpha}{\alpha_k}. \quad (2')$$

Formula (5) gives the number of bits to be allocated in total to the coding of the parameter of sub-band $b_k$.

Finally, with constrained or unconstrained bitrate, each parameter is then quantized (Q) at the coder so as to form the binary or dequantized train ($Q^{-1}$) at the decoder as a function of the number of bits which is allocated to it.

If they are present, the parameters regarding primary and ambient energy distribution, which for their part are coded on a fixed number of bits, must be transmitted first, since they will then be required for the decoding of the parameters coded on a variable number of bits.

At the decoder, the inverse quantization of the train of bits of the spatial parameters makes it necessary to ascertain the number of bits allocated to each parameter. The invention makes it possible to avoid a transmission of additional information about the strategy for allocating bits.

Since the effective spatial "blurring" can be calculated on the basis of the "downmix" alone, it is possible to recalculate the allocation of bits of the spatial parameters by using the same psycho-acoustic model and the same procedure for allocating bits as when encoding. Thus, the transmission of the quantization strategy is dispensed with. On the other hand, this makes it necessary to fix the psycho-acoustic model and the procedure for allocating bits between the encoding and the decoding.

If they are present, the parameters regarding primary and ambient energy distribution, which for their part are coded on a fixed number of bits, were transmitted previously. They are therefore decoded prior to the decoding of the other parameters.

Moreover, if $n_{fixed}$ is non-zero, it is possible to recover a first approximate value of each of the parameters without having to ascertain the number of bits allocated to each of the parameters. Indeed, it suffices to organize the bit train so as to send firstly $n_{fixed}$ high-order bits for each of the parameters, followed by the remaining $N_k$ bits for each parameter. This may be useful if other experimental studies were to show that some position information is in fact necessary for more precise estimation of the MAA. In this case, the sum signal or "downmix" would no longer suffice, and these approximate values of the parameters could serve to estimate the MAA when encoding (respectively when decoding) so as to ascertain the number of bits to be allocated (respectively that have been allocated) to each parameter. Thus, the higher is $n_{fixed}$, the better the approximation of the parameters which is available for the estimation of the MAA.

The coders and decoders such as described with reference to FIG. 1 as well as the allocation device which is the subject of the invention can be integrated into multimedia equipment of "set top box" or audio or video content player type. They can also be integrated into communication equipment of mobile telephone type.

Figure 3:
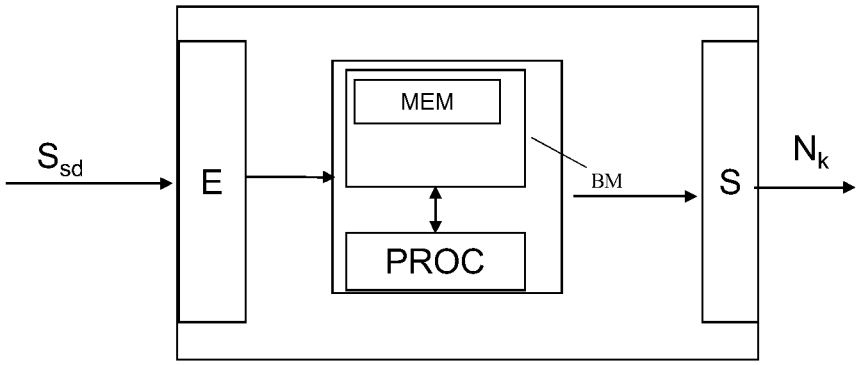
FIG. 3 illustrates a particular hardware configuration of an allocation device according to the invention.

FIG. 3 represents an exemplary embodiment of such an item of equipment into which the allocation device according to the invention is integrated. This device comprises a processor PROC cooperating with a memory block BM comprising a storage and/or work memory MEM.

The memory block can advantageously comprise a computer program comprising code instructions for the implementation of the steps of the allocation method within the meaning of the invention, when these instructions are executed by the processor PROC, and notably the steps of estimating a spatial resolution of the current sub-band on the basis of spectral properties of the sub-band and of determining a number of bits to be allocated to the current sub-band as a function of the estimated spatial resolution.

Typically, the description of FIG. 2 employs the steps of an algorithm of such a computer program. The computer program can also be stored on a memory medium readable by a reader of the device or downloadable to the memory space of the latter.

Such an item of equipment comprises an input module able to receive a sum signal decoded either from a coder by way of a local decoder, or from a decoder.

The device comprises an output module able to transmit the number of bits to be allocated per frequency sub-band to the quantization modules of a coder or to the inverse quantization module of a decoder.

In a possible embodiment, the device thus described can also comprise the coding and/or decoding functions in addition to the allocation functions according to the invention.

The invention claimed is:

1. A method comprising:

allocating quantization bits for spatial information parameters per frequency sub-band, for a parametric coding or decoding of a multichannel audio stream representing a sound scene having a plurality of sound sources and including at least one of quantization or inverse quantization per frequency sub-band of spatial information parameters of the sound sources of the sound scene, wherein allocating comprises;

estimation by an allocation device of a spatial resolution of a current sub-band on the basis of spectral properties of the sub-band; and determination by the allocation device of a number of bits to be allocated to the current sub-band, the number of bits to be allocated being inversely proportional to the estimated spatial resolution.

2. The method as claimed in claim 1, wherein the spectral properties of a sub-band are represented by the central frequency of the sub-band.

3. The method as claimed in claim 1, wherein the spectral properties of a sub-band are properties of energy in the sub-band.

4. The method as claimed in claim 1, wherein the spectral properties of a sub-band are at one and the same time properties of energy in the sub-band and the central frequency of the sub-band.

5. The method as claimed in claim 4, wherein the spatial resolution of a sub-band is estimated furthermore on the basis of the spectral properties of the other sub-bands of a set of sub-bands defining the sound sources.

6. The method as claimed in claim 1, wherein the spectral properties of a sub-band are obtained on the basis of a decoded sum signal arising from a reduction processing of the channels of the multichannel audio stream.

7. The method as claimed in claim 3, wherein the energy properties in a sub-band comprise the properties of primary energy and of ambient energy in the sub-band.

8. The method as claimed in claim 1, wherein the number of bits to be allocated for a sub-band forms part of a predetermined number of bits plus a number of bits already allocated per sub-band.

9. The method as claimed in claim 8, wherein the determination of the number of bits to be allocated for a sub-band is adjusted as a function of the difference between the resolution in this sub-band and a predetermined reference resolution, to which there corresponds a predetermined allocation of reference bits.

10. The method as claimed in claim 1, wherein the method is implemented for a set of non-masked sub-bands which is determined by a step of analysis of energy-related masking between sub-bands.

11. A device for allocating quantization bits for spatial information parameters per frequency sub-band, for a parametric coder or decoder of a multichannel audio stream representing a sound scene consisting of a plurality of sound sources and comprising a module for at least one of quantization or inverse quantization per frequency sub-band of spatial information parameters of the sound sources of the sound scene, wherein the device comprises:

a module configured to estimate a spatial resolution of a current sub-band on the basis of spectral properties of the sub-band; and a module configured to determine a number of bits to be allocated to the current sub-band, the number of bits to be allocated being inversely proportional to the estimated spatial resolution.

12. The device of claim 11, wherein the device comprises a parametric coder of a multichannel audio stream.

13. The device of claim 11, wherein the device comprises a parametric decoder of a multichannel audio stream.

14. A computer-readable memory device comprising a computer program stored thereon and comprising code instructions for implementation of a method for allocating quantization bits for spatial information parameters per frequency sub-band, for a parametric coding or decoding of a multichannel audio stream representing a sound scene having a plurality of sound sources and including at least one of quantization or inverse quantization per frequency sub-band of spatial information parameters of the sound sources of the sound scene, when these instructions are executed by a processor, wherein the method comprises the following steps;

estimation by an allocation device of a spatial resolution of a current sub-band on the basis of spectral properties of the sub-band; and determination by the allocation device of a number of bits to be allocated to the current sub-band, the number of bits to be allocated being inversely proportional to the estimated spatial resolution.

* * * * *